US006050909A

United States Patent [19]

Severa et al.

[11] Patent Number: 6,050,909

[45] Date of Patent: Apr. 18, 2000

[54] GAME RACQUET WITH STRING SLOTS IN INNER WALL

[75] Inventors: William D. Severa, West Chicago; Gerald J. LeVault, Addison; Willie H. McMillan, Bensenville, all of Ill.

[73] Assignee: Wilson Sporting Goods Co., Chicago, Ill.

[21] Appl. No.: 08/874,652

[22] Filed: Jun. 13, 1997

[51] Int. Cl.[7] ..... A63B 49/00

[52] U.S. Cl. ..... 473/524; 473/539

[58] Field of Search ..... 473/524, 539, 473/540

[56] References Cited

U.S. PATENT DOCUMENTS

| | | |
|---|---|---|
| Re. 34,420 | 10/1993 | Darling . |
| 4,681,310 | 7/1987 | Zilinskas . |
| 4,930,778 | 6/1990 | Mizuno . |
| 5,014,987 | 5/1991 | Soong . |
| 5,251,895 | 10/1993 | Darling . |
| 5,332,213 | 7/1994 | Klose . |
| 5,368,295 | 11/1994 | Severa . |
| 5,833,560 | 11/1998 | Davis . |

FOREIGN PATENT DOCUMENTS

| | | |
|---|---|---|
| 0219310A2 | 4/1987 | European Pat. Off. . |
| 2 598 323 | 11/1987 | France . |
| OG35 06 025A1 | 8/1986 | Germany . |
| WO 98/28049 | 7/1998 | WIPO . |

*Primary Examiner*—Sam Rimell

[57] ABSTRACT

A game racquet includes a frame having an elongated shaft which provides a handle and a hoop-shaped head which supports a generally planar string bed. The head includes a lower portion attached to the shaft, a pair of opposed side portions, and an upper portion. Each of the side portions and the upper portion has a hollow tubular cross section having an outer wall and an inner wall. The inner wall of each of the side and upper portions is provided with a plurality of elongated slots which extend perpendicularly to the plane of the strings, and each of the outer walls is provided with a plurality of circular openings which are aligned with the slots and which lie in the plane of the strings. A grommet strip extends along each of the side portions of the head, and a bumper strip extends along the upper portion of the head. Each of the grommet strips and the bumper strip includes a tubular sleeve for each of the circular openings which is aligned with a slot which extends through the circular opening and which terminates outwardly of the aligned slot.

9 Claims, 8 Drawing Sheets

GAME RACQUET WITH STRING SLOTS IN INNER WALL

BACKGROUND

This invention relates to game racquets such as tennis racquets, racquetball racquets, and squash racquets. More particularly, the invention relates to a game racquet frame having elongated string slots in the inner wall of the head.

Game racquets conventionally include a hoop-shaped head which supports a planar string bed. The head provides outside and inside hoops which are defined by the outer and inner walls of the head. The head is drilled with string holes through which the strings are threaded. One or more grommet strips and/or a bumper strip may be mounted on the outside of the head, and the grommet strip and/or bumper strip include tubular sleeves which extend through the string holes and which protect the strings from being abraded by the frame material which defines the edges of the string holes.

Most of the load of the strings is carried by the outside hoop, and the inside hoop is used to locate the string to give it the proper position in the string pattern. This rigid securing of the strings limits the deflection of the string bed, particularly on off-center hits. The rigid holes in the inside hoop also limit the size of the sweetspot of the racquet by not allowing the maximum deflection of the string bed. Impacts of a tennis ball near the top and sides of the frame tend to feel harsh.

Some attempts have been made to modify the traditional rigid locations of the strings at the inside hoop. See, for example, U.S. Pat. Nos. 5,332,213, 5,251,895, Re. 34,420, 5,014,987, and 4,930,778, German O.G. 35 06 025 A1, and French Patent No. 2 598 323. However, those attempts have still limited to some extent the size of the sweetspot of the racquet by not allowing maximum deflection of the string bed in a direction which is perpendicular to the plane of the strings.

SUMMARY OF THE INVENTION

The outer hoop or wall of the head of a racquet frame is drilled with circular string holes in the conventional manner. However, the inside hoop or wall is provided with elongated slots which are aligned with most or all of the string holes in the outer hoop. The longitudinal dimension of each slot extends perpendicularly to the plane of the strings, and the short dimension is just slightly greater than the string diameter. The center of each slot lies in the plane of the strings. A grommet strip extends along the outside of the outer hoop and includes tubular sleeves which extend through the string holes in the outer hoop and which terminate adjacent the inside surface of the outer hoop. Racquet strings are threaded through the string holes and slots and are protected by the sleeves from the edges of the string holes in the outer hoop. The strings can deflect within the slots in the inner hoop in a direction perpendicular to the plane of the strings.

DESCRIPTION OF THE DRAWINGS

The invention will be explained in conjunction with an illustrative embodiment shown in the accompanying drawing, in which.

DESCRIPTION OF SPECIFIC EMBODIMENTS

Figure 1:
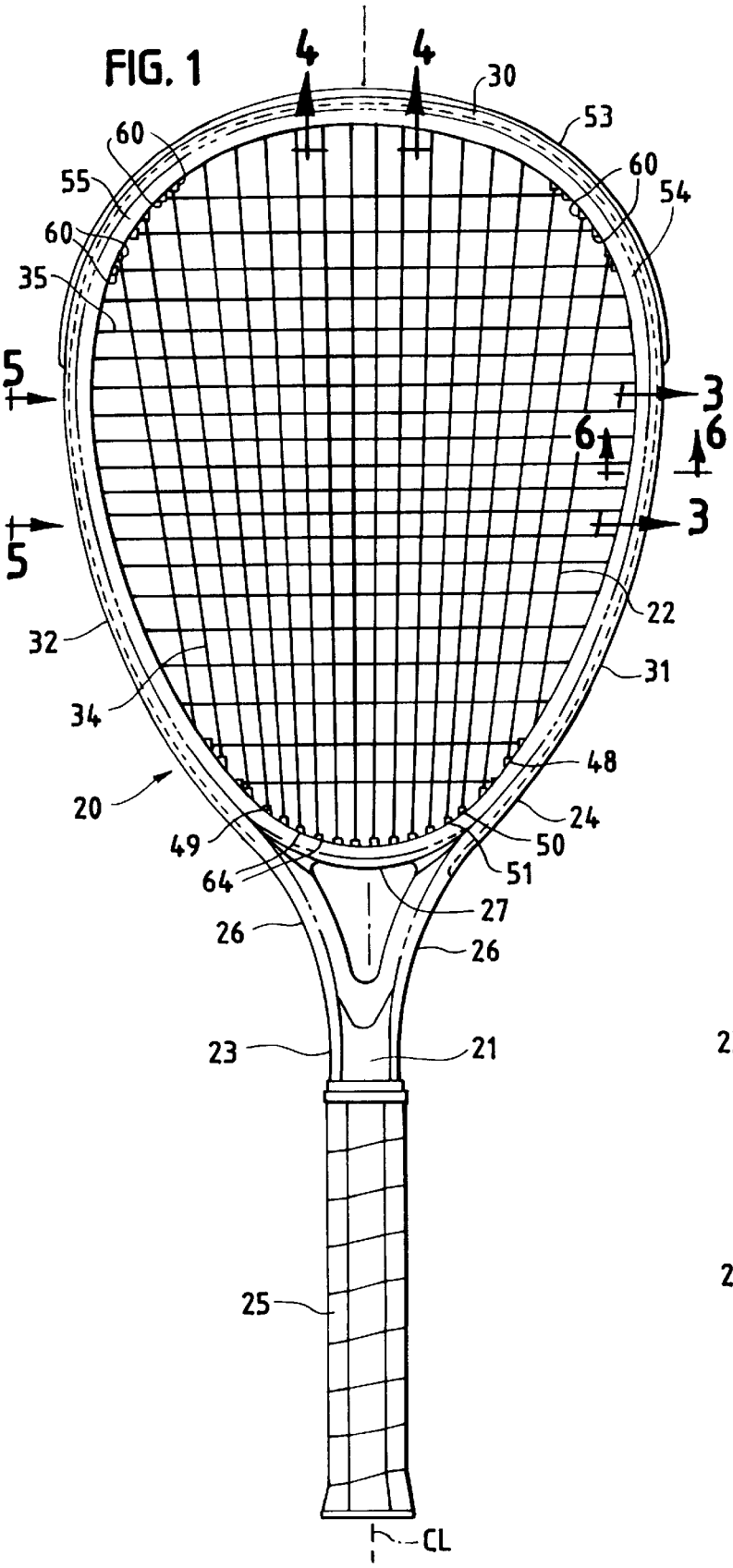
FIG. 1 is a front elevational view of a game racquet formed in accordance with the invention.
Figure 2:
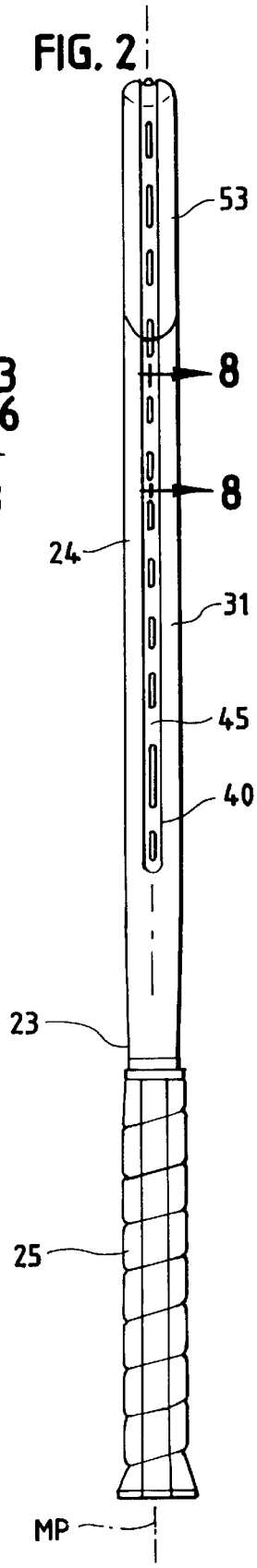
FIG. 2 is a side elevational view of the racquet of FIG. 1.

Referring to FIGS. 1 and 2, a game racquet 20 includes a frame 21 and strings 22. The frame includes an elongated shaft 23 which lies along the longitudinal centerline CL of the frame and a generally planar, hoop-shaped head 24. The string bed is generally parallel and lies in a midplane MP which bisects the height or thickness of the frame in FIG. 2. The lower end of the shaft provides a handle 25 which is wrapped with conventional grip material. The particular racquet illustrated is a tennis racquet, but it will be understood that the invention can be used with other game racquets, for example, racquetball racquets, squash racquets, badminton racquets, etc.

The frame may be formed in the conventional fashion by forming a tube of fibers and resin. The fibers can be graphite, Kevlar, boron, etc. The tube is bent into a hairpin shape to form the top and sides of the head, a pair of diverging throat portions 26, and the shaft. The hairpin surrounds an inflatable bladder. A yoke 27 is attached to the hairpin to form the bottom of the head. The yoke may be formed by wrapping fibers and resin around a foamable resin core.

The hairpin and yoke are placed in a mold cavity having the shape of the frame, the bladder is inflated, and the frame is molded under heat and pressure. The foamable resin inside of the yoke foams and forces the yoke against the mold surface. The portion of the frame which forms the top 30 and sides 31 and 32 of the head and the throat members 26 is molded into a hollow, tubular structure by virtue of the inflated bladder. The yoke 27 is filled with solid foamed resin.

The racquet frame illustrated in FIGS. 1 and 2 has the same general shape as the frame illustrated in U.S. Pat. No. 5,368,295. However, as will be explained hereinafter, the string holes, the grommet strips, and the bumper strip are novel.

The particular head shown in the drawing is fan-shaped and is wider at the top than at the bottom. The main strings or longitudinal strings 34 are substantially parallel to the longitudinal centerline CL in the middle of the head, and the main strings to the right and left of the two middle main strings diverge outwardly from the bottom of the head to the top. The head can also have an oval shape and parallel main strings. As used herein and in the claims, main strings which are described as being substantially parallel to the longitudinal centerline include the diverging main strings illustrated in FIG. 1.

The racquet also includes cross strings 35 which extend perpendicularly to the longitudinal centerline.

Figure 4:
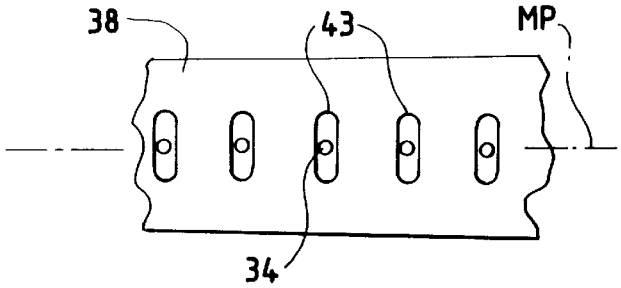
FIG. 4 is a fragmentary sectional view taken along the line 4—4 of FIG. 1.
Figure 6:
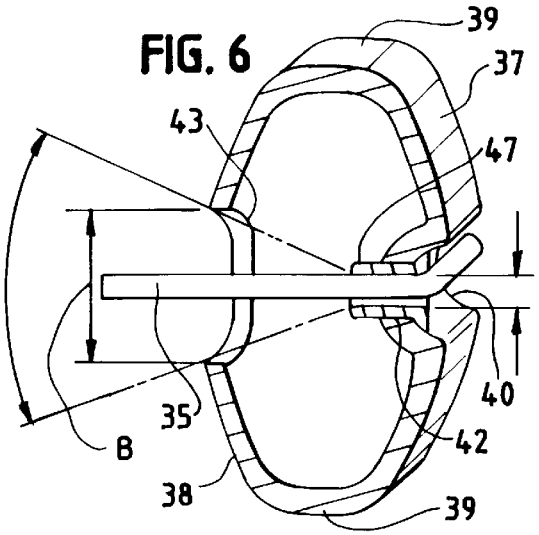
FIG. 6 is a fragmentary perspective sectional view taken generally along the line 6—6 of FIG. 1.
Figure 8:
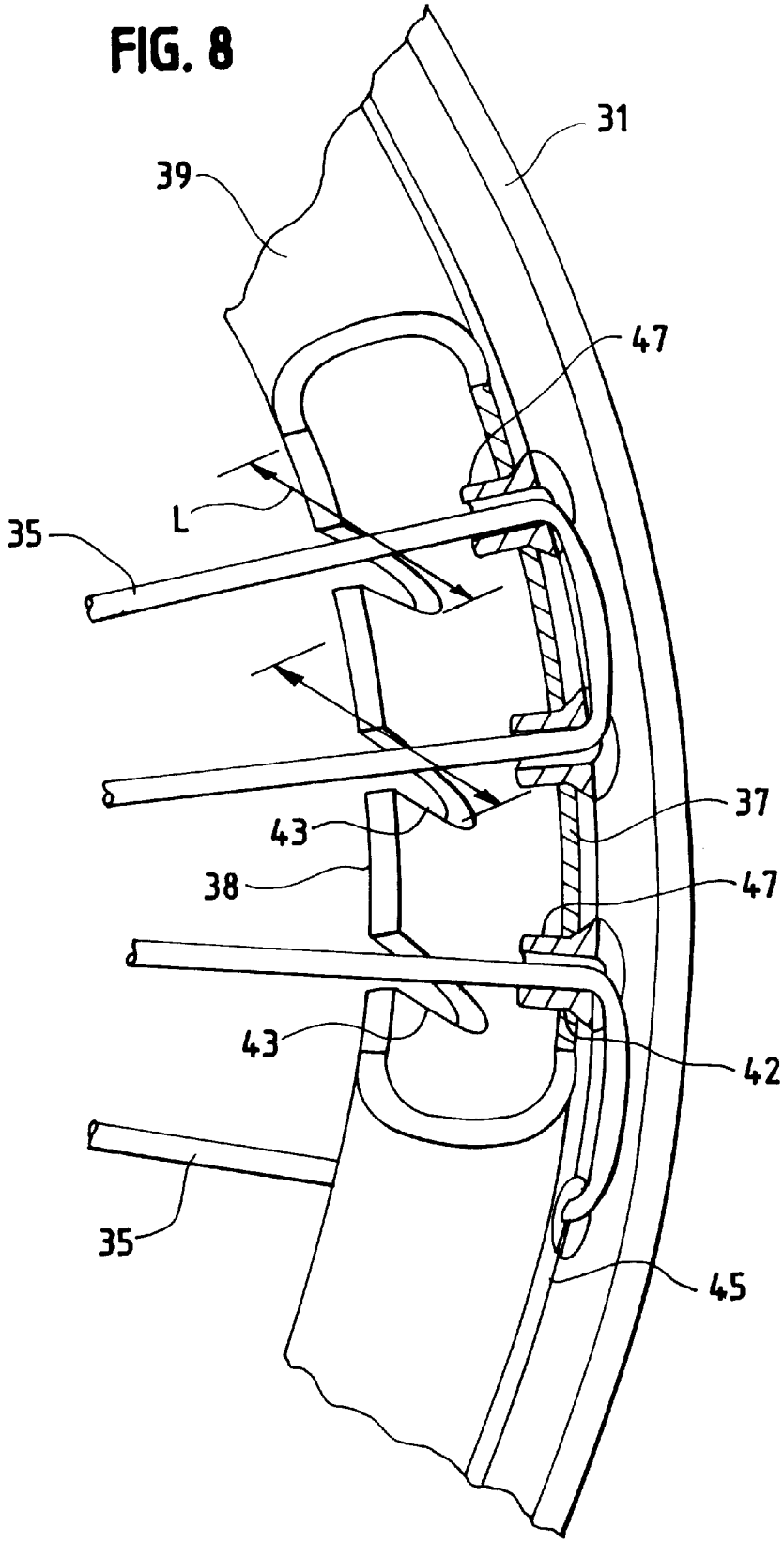
FIG. 8 is a fragmentary perspective sectional view taken generally along the line 8—8 of FIG. 2.

Referring to FIGS. 6 and 8, each side portion of the head has a tubular cross section and includes an outer wall or hoop 37, an inner wall or hoop 38, and side walls 39. A string groove 40 is molded into the outer wall. Circular openings 42 (FIG. 5) are drilled in the outer wall, and elongated slots 43 (FIGS. 4 and 6) are formed in the inner wall opposite at least some of the circular openings 42. The circular openings lie in the midplane MP of the head, and the slots extend perpendicularly to the midplane and to the string bed. The center of each slot is axially aligned with the center of a circular opening and lies in the midplane MP.

Figure 5:
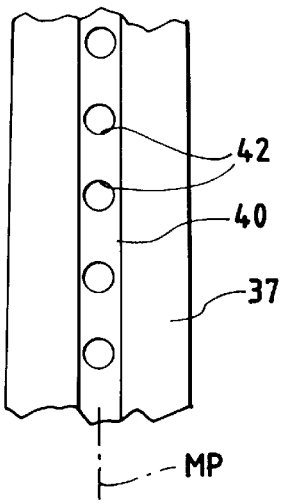
FIG. 5 is a fragmentary side elevational view taken along the line 5—5 of FIG. 1 with the strings and grommet strip being omitted.

The top portion 30 of the head also has a tubular cross section similar to the cross section illustrated in FIG. 6 and includes an outer wall or hoop, an inner wall or hoop, and opposite side walls. The outer wall of the top portion has the same shape which is shown in FIG. 5 and is also provided with circular openings 42 which are aligned with the midplane MP. The inner wall is provided with elongated slots 43 (FIG. 4) which extend perpendicularly to the midplane MP.

Figure 9:
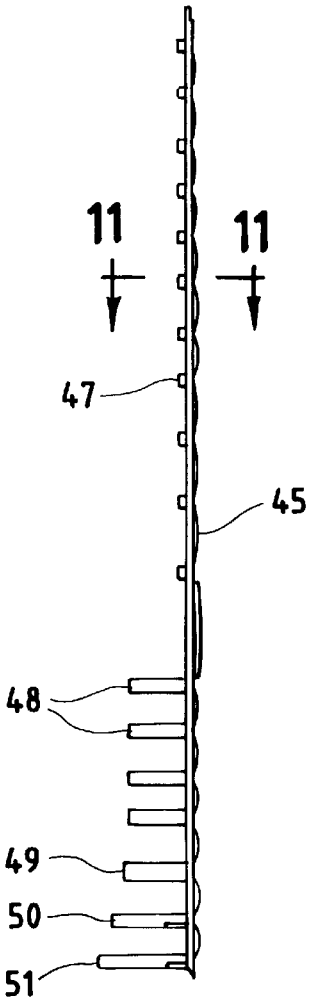
FIG. 9 is a side elevational view of one of the grommet strips.
Figure 10:
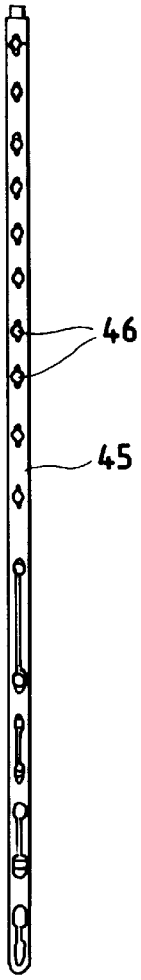
FIG. 10 is a top plan view of the grommet strip of FIG. 9.
Figure 11:
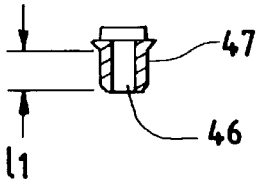
FIG. 11 is a sectional view taken along the line 11—11 of FIG. 9.

A grommet strip 45 (FIGS. 2, 9, and 10) is positioned within the string groove 40 in the outer wall of each of the side portions 31 and 32 of the head. Referring to FIGS. 9–11, the grommet strip is provided with string holes 46 which are spaced to coincide with the circular openings 42 in the sides of the head. A short tubular sleeve 47 extends from the inside surface of the grommet strip for each of the circular openings 42 which is aligned with one of the slots 43. Longer tubular sleeves 48–51 extend from the lower end portion of the grommet strip for the openings 42 which are not aligned with a slot 43. Those openings 42 are aligned with circular openings rather than slots in the inner wall of the head.

Referring to FIGS. 6 and 8, each short tubular sleeve 47 is inserted into a circular opening 42 and terminates just inwardly of the inner surface of the outer wall 37. Each of the longer sleeves 48–51 is inserted through circular openings in both the outer and inner walls of the head as can be seen in the lower portion of the head in FIG. 1.

A bumper strip 53 (FIGS. 1, 2, 13, and 14) extends along the top portion 30 of the head, along the intermediate or "corner" portions 54 and 55 of the head between the top portion 30 and the two side portions 31 and 32, and over a portion of each of the sides 31 and 32. The two ends 56 and 57 of the bumper strip slightly overlap the upper ends of the two grommet strips on the sides of the head.

Figure 13:
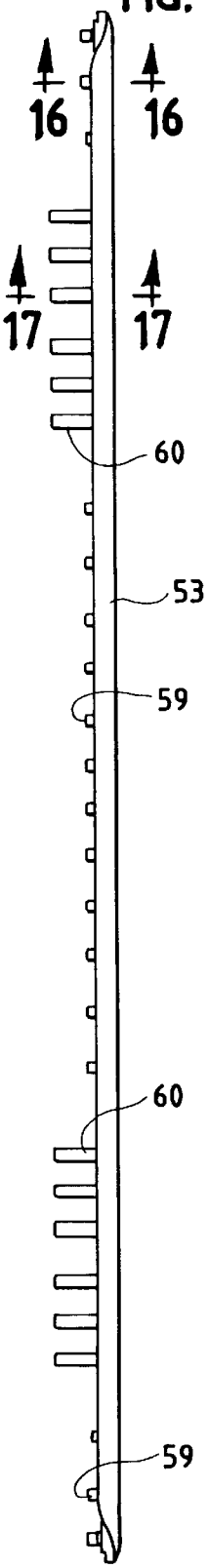
FIG. 13 is a side elevational view of the bumper strip.
Figure 14:
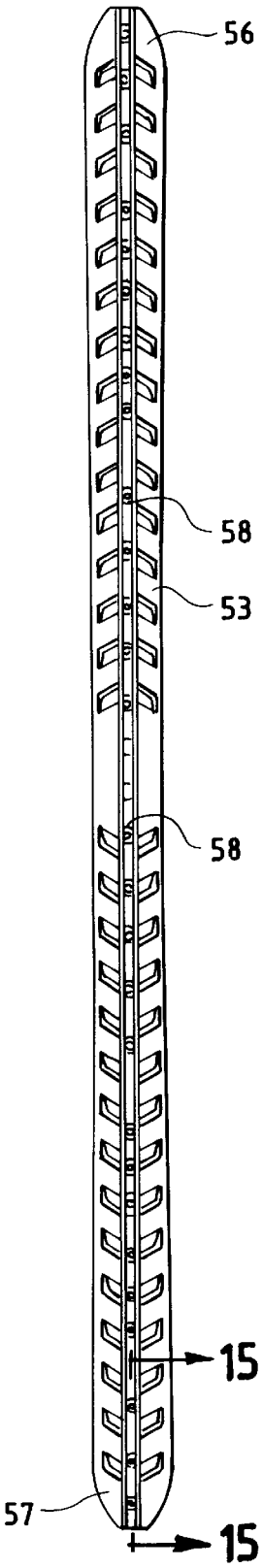
FIG. 14 is a top plan view of the bumper strip.

Referring to FIGS. 13 and 14, the bumper strip is provided with string holes 58 which are spaced to coincide with the circular openings 42 in the top portion of the head. A short tubular sleeve 59 extends from the inside surface of the bumper strip for each of the circular openings which is aligned with one of the slots 43. Longer tubular sleeves 60 extend from the bumper strip for the openings 42 which are not aligned with a slot 43. Those openings 42 are aligned with circular openings rather than slots in the inner wall of the head.

Each short sleeve of the bumper strip is inserted into a circular opening 42 in the head and terminates just inwardly of the inner surface of the outer wall. Each of the longer sleeves 60 is inserted through circular openings in both the outer and inner walls of the head as can be seen in the "corner" portions of the head in FIG. 1.

Figure 15:
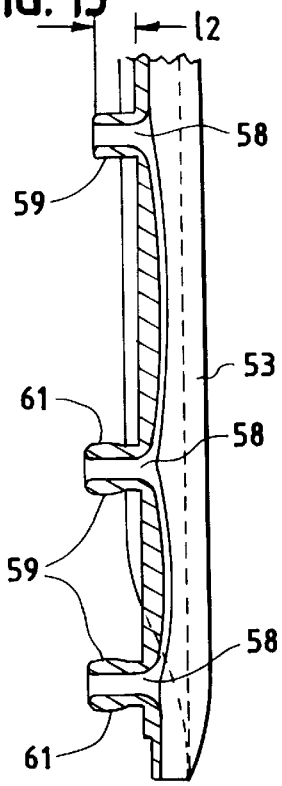
FIG. 15 is a sectional view taken along the line 15—15 of FIG. 14.
Figure 16:
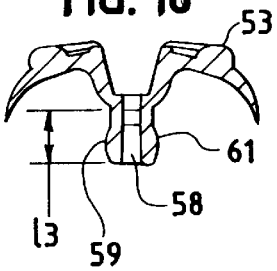
FIG. 16 is a sectional view taken along the line 16—16 of FIG. 13.
Figure 17:
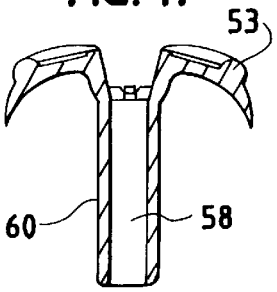
FIG. 17 is a sectional view taken along the line 17—17 of FIG. 13.

Referring to FIGS. 15 and 16, the last two short sleeves on each end of the bumper strip include bulbous outer surfaces 61 which frictionally engage the edges of the openings 42 for retaining the bumper strip on the frame.

Figure 12:
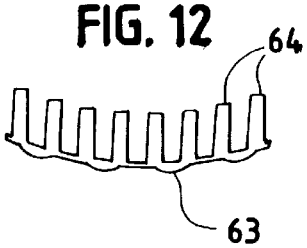
FIG. 12 is a side elevational view of the grommet strip for the yoke.

A generally U-shaped grommet strip 63 (FIG. 12) extends around the outer surface of the yoke 27. The grommet strip 63 includes tubular sleeves 64 which surround string holes in the grommet strip. The sleeves 64 are inserted into circular openings which are drilled entirely through the foam-filled yoke.

The main strings 34 and cross strings 35 are threaded through the string holes of the grommet strips 45 and 63 and the bumper strip 53 in the conventional manner. In the particular embodiment illustrated in FIG. 1, 12 main strings extend through slots 43 in the inner wall or hoop of the top portion 30 of the head, and six main strings extend through long tubular sleeves 60 of the bumper strip 53. The bottom portions of all of the main strings extend through the long tubular sleeves 63 of the yoke grommet strip 64 or the long tubular sleeves 49–51 of the grommet strips 45. Fifteen cross strings extend through slots 43 in the side portions 31 and 32 of the head, and five cross strings extend through long tubular sleeves 48 of the grommet strips 45 and long tubular sleeves 60 of the bumper strip 53. In the embodiment of FIG. 1, the racquet head is provided with a total of 76 string openings in the inner hoop, and 42 of them, or 55%, are provided by elongated slots 43 in the inner hoop.

In one commercial embodiment of the invention, 12 of the main strings extend through slots 43 in the inner hoop of the top portion, six main strings extend through the long tubular sleeves 60 of the bumper strip 53, 14 cross strings extend through slots 43 in the side portions of the head, and five cross strings extend through the long tubular sleeves of the bumper strip 53 and the grommet strips 45. The commercial racquet includes a total of 74 string openings in the inner hoop, and 40 of them, or 54%, are provided by elongated slots 43 in the inner hoop.

A greater or smaller number of elongated slots can be used in the inner hoop if desired. For example, the inner hoop can be provided with an elongated slot for each of the string openings in the outer hoop. However, it is believed that it is not necessary to use elongated slots for 100% of the string openings in the inner hoop in order to obtain the benefits of the invention. For example, using elongated slots for about 40% to about 70% of the string holes in the inner hoop will provide benefits of increased string deflection and increased coefficients of restitution as will be explained hereinafter.

Figure 3:
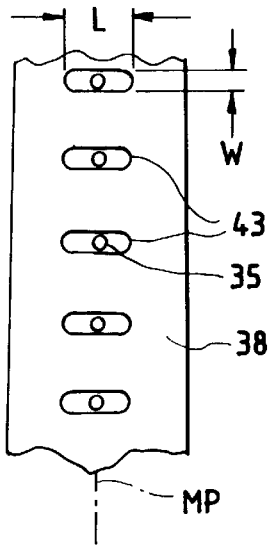
FIG. 3 is a fragmentary sectional view taken along the line 3—3 of FIG. 1.

In one specific embodiment of the invention, the slots 43 had a long dimension L (FIG. 3) of 10 mm and a short dimension or width W of 3 mm. The diameter of the strings was 1.3 mm. The length $l_1$ (FIG. 11) of the tubular sleeves 47 of the grommet strip was 2.50 mm, the length $l_2$ (FIG. 15) of the tubular sleeves 59 of the bumper strip without the bulbous surface 61 was 2.70 mm, and the length $l_3$ of the sleeves 59 with the bulbous surface was 4.00 mm.

The elongated slots 43 in the side portions and the top portion of the head allow the strings to deflect more in a direction perpendicular to the plane of the strings than conventional circular string holes which constrict movement of the strings. The strings which pass through the elongated slots are allowed to deflect from the string holes in the outer hoop rather than the inner loop, which effectively increases the hitting area of the racquet. For example, a racquet having a strung surface area of 112 square inches plays like a 120 square inch racquet.

Figure 7:
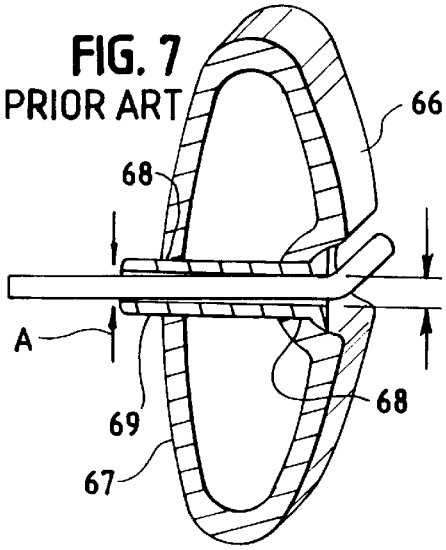
FIG. 7 PRIOR ART
FIG. 7 is a view similar to FIG. 6 of a prior art racquet.

The increased deflection permitted by the elongated slots can be seen by comparing FIG. 6 and FIG. 7. FIG. 7 illustrates a conventional prior art racquet frame having an outer hoop 66, an inner hoop 67, and circular string holes 68 drilled in both the inner and outer hoops. Tubular sleeves 69 of a conventional grommet strip extend through the string openings in both the outer and inner hoops.

The inside diameter of the string hole in both the short grommet sleeve 47 of FIG. 6 and the long grommet sleeve 69 of FIG. 7 is about 1.7 mm for a 1.3 mm diameter string. The string in FIG. 7 therefore can deflect about 0.4 mm as indicated by the arrows A. In contrast, the 1.3 mm diameter string in FIG. 6 can deflect 8.7 mm within the 10 mm long slot 43 as indicated by the arrows B.

The short tubular sleeves of the grommet strips 45 and the bumper strip 53 protect the strings from being abraded by the edges of the string openings in the outer hoop. However, the portions of the strings which pass through the elongated slots 43 are not protected by tubular sleeves. In the preferred embodiment, the edges of the elongated slots are coated with a rubberized paint in order to protect the strings from being abraded. Suitable rubberized paints include Nextel Suede paint from Red Spot Paint and Varnish Co. of Evansville, Ind., and Softouch paint from the ALSA Corp. of Vernon, Calif. Nextel Suede is a polyurethane base paint, and Softouch is a urethane base paint. Both paints have a rubberized feel and consistency. Another rubberized paint is made by Paint Company of Taiwan and includes 15% by weight desmophen 670, 15% by weight desmophen N-75, 30% by weight suede paint powder, 20% by weight solvent, and 20% by weight of other ingredients.

The 3 mm width of the slots allows some clearance between the 1.3 mm diameter string and the longitudinal edges of the slots. However, the 3 mm width still restricts the string from excessive movement in a direction which lies within the plane of the strings, thereby maintaining the locations of the strings and the integrity of the string pattern.

The circular openings in the outer hoop can be drilled in the conventional manner. The slots in the inner hoop can be formed by first drilling a 3 mm hole and then elongating the hole to form a slot.

Conventional string holes are drilled in the racquet frame by drilling the holes through both the inner and outer hoops along a radius which extends generally toward the center of the head. In racquets which are made in accordance with the invention, both the circular openings in the outer hoop and the elongated slots in the inner hoop are preferably drilled in a direction which is aligned with the string which will be positioned in the circular opening and the slot. In other words, the circular openings and elongated slots in the side portions of the head extend through the inner and outer hoops in a direction which extends parallel to the cross strings. The circular openings and elongated slots in the top portion of the head extend through the outer and inner hoops in directions which extend parallel to the main strings. The surfaces of the hoops or frame walls which define the openings and slots therefore lie in planes which extend parallel to the cross strings (perpendicular to the longitudinal centerline CL) in the side portions of the frame and substantially parallel to the main strings (substantially parallel to the longitudinal centerline) in the top portion of the frame.

The increased string deflection which is permitted by the elongated slots softens the string bed and helps create a flat coefficient of restitution. The typical harsh feeling of an off-center hit on a conventional racquet is made much more comfortable because deflection of the string bed is not constricted for ball impacts close to the frame. Off-center hits also tend to be more accurate. Impacts high on the racquet strings when serving will not feel as harsh. The foregoing benefits are obtained without decreasing the power level of the racquet.

Figure 18:
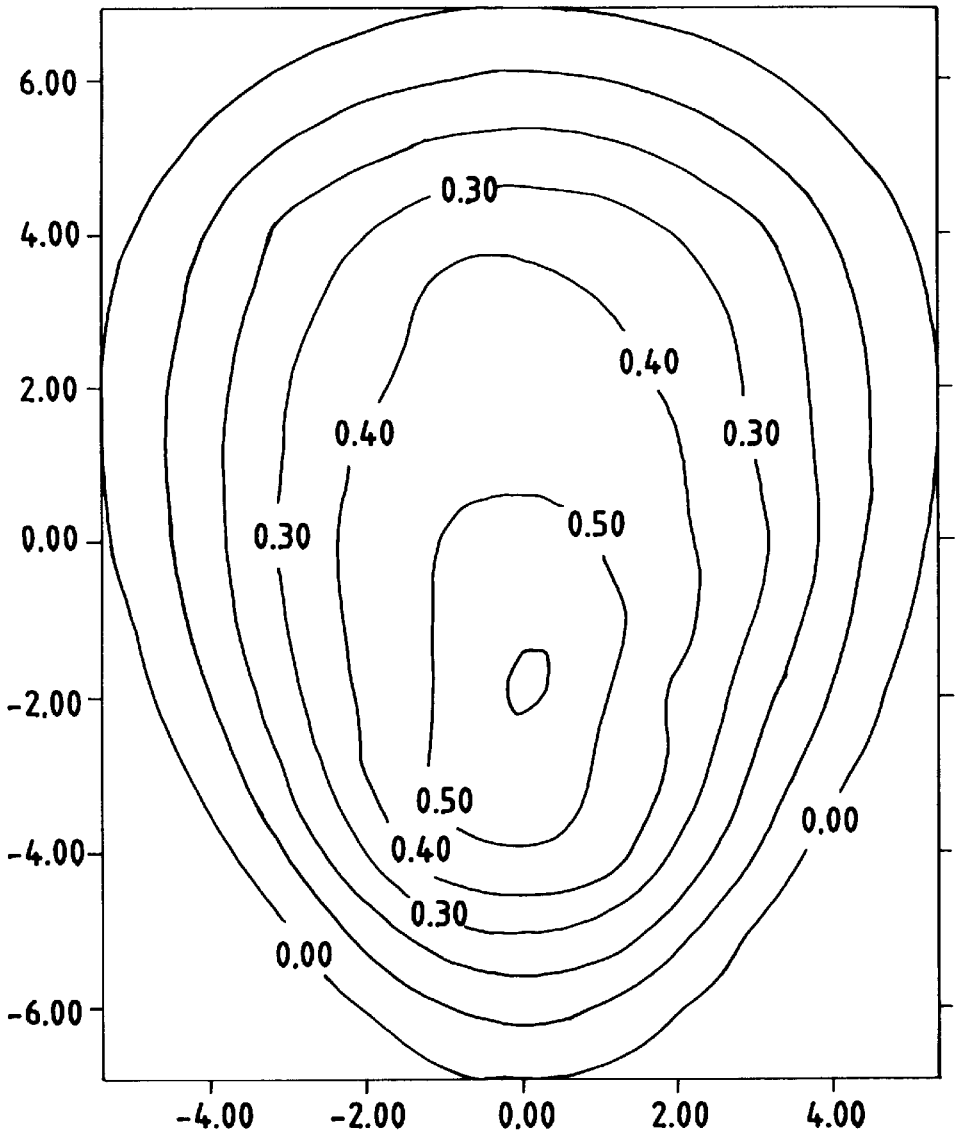
FIG. 18 is a two dimensional mapping of the coefficients of restitution on the string bed of the inventive racquet.
Figure 19:
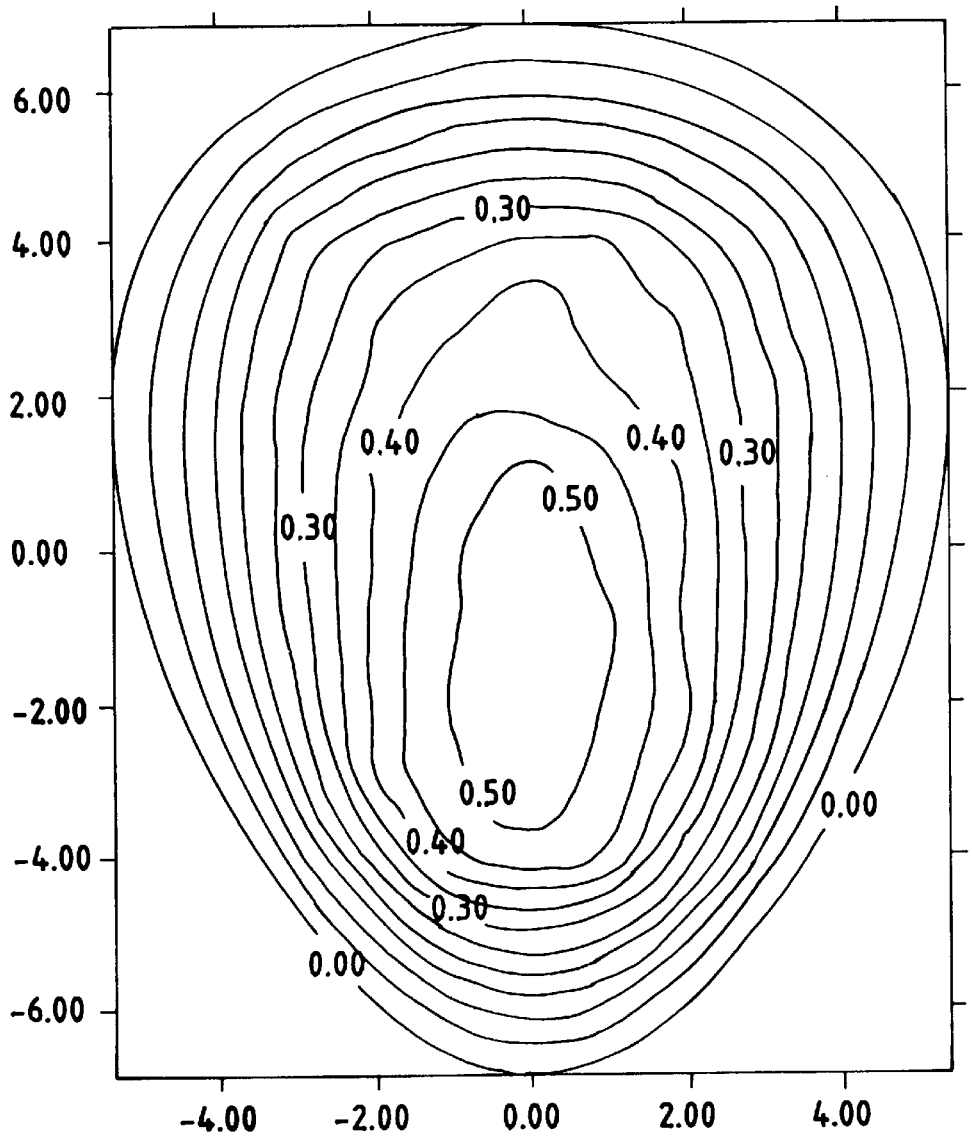
FIG. 19 PRIOR ART
FIG. 19 is a two dimensional mapping of the coefficients of restitution on a prior art racquet.

FIG. 18 is a mapping of the coefficients of restitution on the string bed of a racquet made in accordance with the invention, and FIG. 19 is a mapping of the coefficients of restitution on a string bed of a prior art racquet. The coefficient of restitution is the ratio of the rebound velocity of a tennis ball to the incoming velocity of a tennis ball. The coefficients of restitution of FIGS. 18 and 19 were measured by using an incoming velocity of 90 feet per second. The prior art racquet represented by FIG. 19 was a Wilson Sledge Hammer 3.8 racquet having a strung surface of 112 square inches. The racquet represented by FIG. 18 was the same racquet which was modified to include the elongated slots as previously described with respect to the commercial racquet embodiment of the invention.

In both FIGS. 18 and 19, the line labeled 0.50 represents the border of the area on the strings where the coefficient of restitution was 0.50 or greater. The line indicated as 0.40 represents the border of the area on the strings where the coefficient of restitution was 0.40 or greater. Similarly, the other lines in FIGS. 18 and 19 represent borders for the areas on the strings for various values of coefficients of restitution.

The numbers on the horizontal and vertical axes of FIGS. 18 and 19 represent the distance from the center of the strung surface. For example, the center of the strung surface is indicated as 0.00. Two inches to the right of the strung surface is indicated as 2.00, 2 inches to the left of the center is indicated as −2.00, etc.

A comparison of FIGS. 18 and 19 indicates that the racquet made in accordance with the invention has a greater area within each of the lines for various coefficients of restitution. A comparison of the areas is set forth in Table 1. A Z value represents a constant COR value. The percentage figures in columns 2 and 3 represent the area of the string surface in which the COR was at least as great as the Z value. The fourth column indicates that the inventive racquet of FIG. 18 has a greater area within each of the Z lines.

Figure 20:
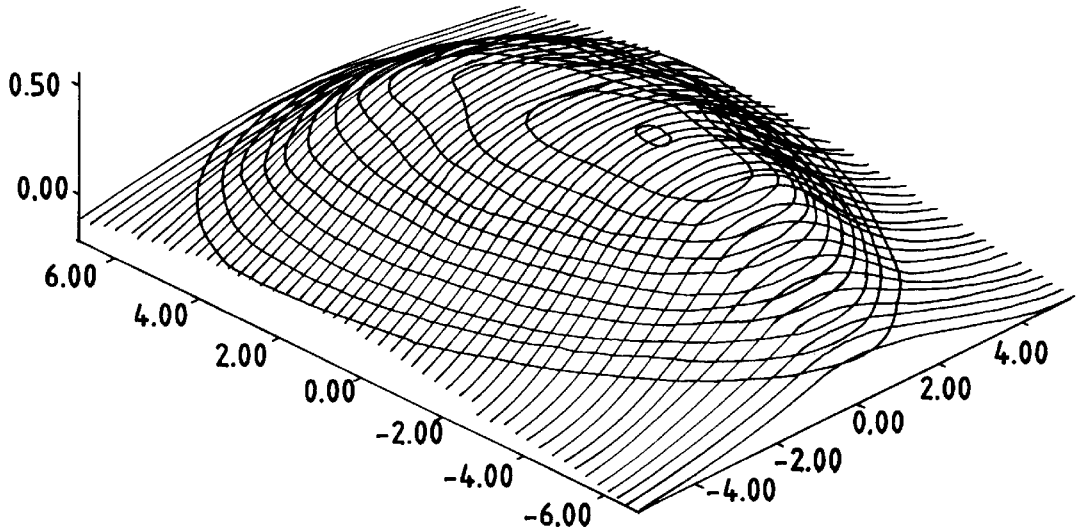
FIG. 20 is a three dimensional mapping of coefficients of restitution for the inventive racquet.
Figure 21:
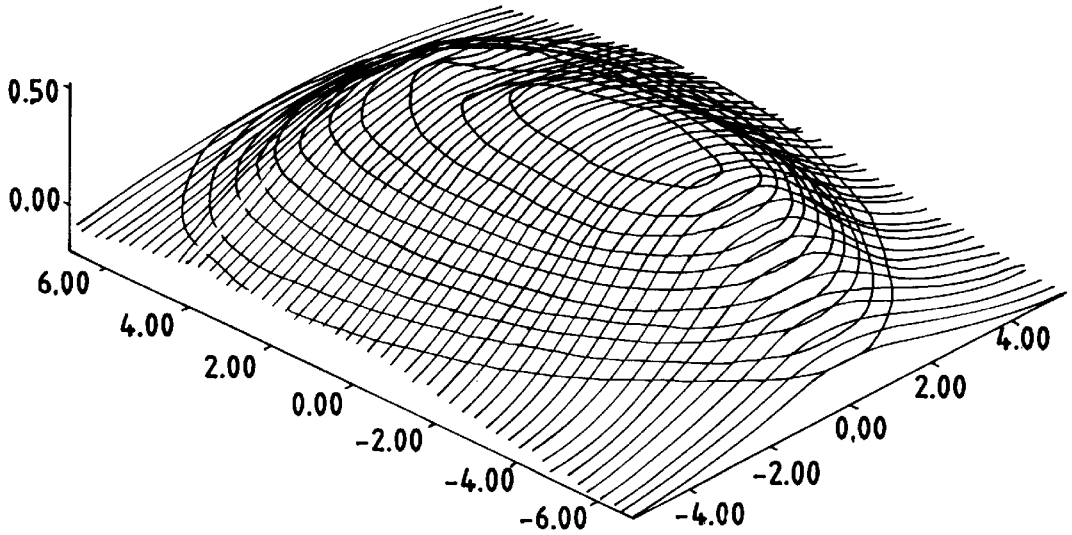
FIG. 21 PRIOR ART
FIG. 21 is a three dimensional mapping of coefficients of restitution for the prior art racquet.

Table 2 compares three dimensional volume measurements of the three dimensional COR mappings of FIGS. 20 and 21. For volume measurements, the magnitude of the coefficients of restitution of a racquet is plotted across a grid representing the string bed. The vertical or Z axis represents the magnitude of COR. Each block of the grid will contain a volume in cubic units between Z=0 and the surface represented by the COR plot. The sum of this distribution of magnitude volumes is equivalent to the total "volume" COR of a particular racquet. The total response can therefore be quantified.

TABLE 1

| Area of COR Mapping | | | |
|---|---|---|---|
| Z | Racquet of FIG. 18 % Inside Z contour | Racquet of FIG. 19 % Inside Z contour | % Increase for FIG. 18 |
| 0.00 | 100.0% | 100.0% | 0.0% |
| 0.05 | 86.6% | 85.8% | 0.8% |
| 0.10 | 75.8% | 74.4% | 1.4% |
| 0.15 | 66.5% | 65.5% | 1.0% |
| 0.20 | 58.0% | 55.7% | 2.2% |
| 0.25 | 49.9% | 47.4% | 2.5% |
| 0.30 | 41.9% | 39.5% | 2.4% |
| 0.35 | 33.9% | 31.4% | 2.5% |
| 0.40 | 26.0% | 22.5% | 3.4% |
| 0.45 | 17.5% | 14.0% | 3.5% |
| 0.50 | 8.1% | 6.4% | 1.7% |
| 0.55 | 0.3% | 0.0% | 0.3% |

TABLE 2

| Volume of COR Mapping | | | |
|---|---|---|---|
| Z | Racquet of FIG. 18 % Inside Z contour | Racquet of FIG. 19 % Inside Z contour | % Increase for FIG. 18 |
| 0.00 | 100.0% | 100.0% | 0.0% |
| 0.05 | 81.9% | 81.1% | 0.8% |
| 0.10 | 66.1% | 64.8% | 1.3% |
| 0.15 | 52.3% | 50.6% | 1.7% |
| 0.20 | 40.1% | 38.3% | 1.8% |
| 0.25 | 29.6% | 27.8% | 1.9% |
| 0.30 | 20.7% | 18.9% | 1.8% |
| 0.35 | 13.3% | 11.7% | 1.7% |
| 0.40 | 7.5% | 6.2% | 1.3% |
| 0.45 | 3.2% | 2.5% | 0.8% |
| 0.50 | 0.8% | 0.3% | 0.4% |
| 0.55 | 0.0% | 0.0% | 0.0% |

While in the foregoing specification a detailed description of specific embodiments of the invention was set forth for the purpose of illustration, it will be understood that many of the details herein given can be varied considerably by those skilled in the art without departing from the spirit and scope of the invention.

We claim:

1. A game racquet comprising:

a frame having an elongated shaft defining a longitudinal centerline for the frame and a hoop-shaped generally planar head, a generally planar string bed supported by the head, the string bed including main strings which extend generally parallel to the longitudinal centerline of the frame and cross strings which extend generally perpendicularly to the centerline of the frame, the head having a lower portion attached to the shaft, a pair of opposed side portions, and an upper portion, each of the side portions of the head having a hollow tubular cross section having an outer wall and an inner wall, the inner wall of each of the side portions having a plurality of elongated slots, each of the slots having a peripheral edge having a major dimension which extends generally perpendicularly to the string bed and a minor dimension which extends generally parallel to the string bed, each of the slots having a pair of narrow ends which are spaced from the plane of the string bed, the outer wall of each of the side portions having a plurality of circular openings which are aligned with the slots and which lie generally in the plane of the string bed, a grommet strip extending along each of the side portions of the head, the grommet strip including a tubular sleeve for each of said circular openings each sleeve extending through one of the circular openings, and terminating outwardly of the aligned slot whereby the sleeve does not extend into the aligned slot and the peripheral edge of the aligned slot is free of grommet material, one of the cross strings extending through each of the tubular sleeves and the aligned slot and being deflectable from the end of the tubular sleeve to the narrow ends of the slot.

2. The racquet of claim 1 in which the outer wall of each of the side portions of the head has an inner surface and each of the tubular sleeves of the grommet strip includes an inner end which is adjacent the inner surface of the outer wall and which is spaced from the inner wall of the side portion.

3. The racquet of claim 1 in which each of the slots in the side portions includes a pair of longitudinally extending side surfaces which lie in planes which extend parallel to the cross strings.

4. The racquet of claim 1 in which the peripheral edge of each of the slots has a major dimension of about 10 mm.

5. The racquet of claim 4 in which the peripheral edge of each of the slots has a minor dimension of about 3 mm.

6. The racquet of claim 1 in which the peripheral edge of each of the slots has a major dimension of about 7.7 times the diameter of the cross strings.

7. The racquet of claim 1 in which the major dimension of the peripheral edge of each of the slots is such that a cross string can deflect about 8.7 mm within the slot.

8. The racquet of claim 1 in which the upper portion of the head has a hollow tubular cross section having an outer wall and an inner wall, the outer wall of the upper portion having a plurality of elongated slots, each of the slots having a peripheral edge having a major dimension which extends generally perpendicularly to the string bed and a minor dimension which extends generally parallel to the string bed, each of the slots having a pair of narrow ends which are spaced from the plane of the string bed, the outer wall of the upper portion having a plurality of circular openings which are aligned with the slots in the upper portion and which lie generally in the plane of the string bed, a tubular grommet sleeve extending through each of the circular openings and terminating outwardly of the aligned slot whereby the sleeve does not extend into the aligned slot and the peripheral edge of the aligned slot is free of grommet material, one of the main strings extending through each of the tubular sleeves in the upper portion and being deflectable from the end of the tubular sleeve to the narrow ends of the slot.

9. The racquet of claim 1 in which each of the circular openings has a diameter substantially the same as the diameter of the tubular sleeves of the grommet strip and each of the elongated slots has a long dimension which is substantially greater than the diameter of the tubular sleeves.

* * * * *